United States Patent [19]

Nishida et al.

[11] 4,276,036

[45] Jun. 30, 1981

[54] EXHAUST MEANS FOR MARINE PROPULSION UNIT

[75] Inventors: Yasuhiro Nishida, Iwata; Yasuo Kondo, Shizuoka, both of Japan

[73] Assignee: Yamaha Matsudoki Kabushiki Kaisha, Japan

[21] Appl. No.: 947,634

[22] Filed: Oct. 2, 1978

[30] Foreign Application Priority Data

Oct. 4, 1977 [JP] Japan ..... 52-133981[U]

[51] Int. Cl.[3] ..... B63H 1/14; B63H 5/06

[52] U.S. Cl. ..... 440/89; 416/93 A; 440/78; 440/900

[58] Field of Search ..... 416/93 R, 93 A, 93 M, 416/94; 115/17, 18, 73, 75, 34 R, 35; 440/89, 78, 900

[56] References Cited

U.S. PATENT DOCUMENTS

| | | | |
|---|---|---|---|
| 2,948,252 | 8/1960 | Alexander | 115/34 R |
| 3,356,151 | 12/1967 | Strang | 416/93 M |
| 3,554,665 | 1/1971 | Lorenz | 416/93 A |
| 3,764,228 | 10/1973 | Shook | 416/93 A |

*Primary Examiner*—Trygve M. Blix
*Assistant Examiner*—D. W. Keen
*Attorney, Agent, or Firm*—Kerkam, Stowell, Kondracki & Clarke

[57] ABSTRACT

Marine propulsion unit having a propeller assembly formed with exhaust gas passages through the propeller hub. An outer pipe is provided to encircle the propeller hub with a radial spacing and has a rear end extending beyond the rear end of the hub so that the exhaust gas is forced to flow, during a reverse movement, from the exhaust gas passage in the hub to the space between the hub and the outer pipe.

5 Claims, 9 Drawing Figures

EXHAUST MEANS FOR MARINE PROPULSION UNIT

The present invention relates to marine propulsion units such as outboard propulsion units and stern drive units and more particularly to exhaust means therefor.

It is a common practice from the viewpoint of suppressing exhaust noise to discharge engine exhaust gas of an outboard marine propulsion unit into water. It has also been known in inboard outboard units or stern drive units to discharge engine exhaust gas into water. For the purpose, it has been known to provide exhaust passage means in and along propeller hub means so that the engine exhaust gas is discharged through an exhaust opening provided at the rear end of the propeller hub means. In this arrangement, however, problems have been encountered in that during a reverse or rearward movement the exhaust gas discharged from the exhaust opening is mixed in bubble form with water stream which is being passed through the propeller. Such bubbles of exhaust gas cause a significant decrease in the thrust of the propulsion unit and moreover produce rough or unstable engine operation due to changes in load on the propeller. Sometimes, such bubbles may cause a racing of the propeller so that the engine speed may exceed an allowable limit and damages may be produced in the engine and/or bearings.

In the U.S. Pat. No. 3,754,837 issued on Aug. 28, 1973 to William J. Shimankas discloses a propulsion unit in which the aforementioned problems may substantially be eliminated. In the arrangement as proposed by the patent, the propeller has an outer and inner hubs which are radially spaced apart so as to provide exhaust gas passageways. The propeller is mounted on a propeller shaft for axial sliding movement within a certain limit and, in forward movement, the propeller is slidably moved axially forwardly on the propeller shaft until the forward end of the outer hub abuts the lower portion of the unit so that the exhaust gas passageways in the propeller are communicated with exhaust gas passage means in the unit housing. Thus, the exhaust gas is discharged through the passageways in the propeller in the rearward direction.

In reverse movement, however, the propeller is displaced axially along the propeller shaft in rearward direction under its own thrust so that the forward end of the outer hub is moved apart from the lower portion of the unit. Thus the exhaust passage means in the unit housing is opened to the surrounding water through a space between the outer propeller hub and the unit housing. The exhaust gas is therefore discharged in front of the propeller or to the downstream side of the propeller as seen in the direction of movement.

The arrangement may be effective eliminating or at least decreasing the problems of thrust decrease caused by the exhaust gas bubbles passing through the propeller in reverse movement. However, in order for accomplishing the desired result, complicated mechanisms are required because the propeller is necessarily mounted on the propeller shaft for axial movement.

It is therefore an object of the present invention to provide a marine propulsion unit having exhaust means which is simple in structure but free from the problems caused by the exhaust gas bubbles in reverse movement.

Another object of the present invention is to provide exhaust means including simple means for preventing exhaust gas bubbles from being passed through the propeller in reverse movement.

According to the present invention, the above and other objects can be accomplished by a marine propulsion unit comprising housing means which is formed with engine exhaust gas passage means and has a lower portion supporting propeller shaft means, propeller means mounted on said propeller shaft means and including hub means and blade means, said hub means being formed with exhaust passage means which is extending axially along the hub means and connected at one end with said exhaust gas passage means in the housing means, the other end of the exhaust passage means being opened rearwardly of the hub means, outer pipe means radially spaced apart from said hub means to sorround at least rear portion of said hub means and extending rearwardly beyond said other end of the exhaust passage means in the hub means.

The outer pipe means may be formed integrally with the hub means or separately from and thereafter connected for example by welding to the hub means. Alternatively, the outer pipe means may be connected to the hub means through suitable fasteners such as bolts or screws. The outer pipe means may or may not extend forwardly beyond the blade means. In a preferable mode of the present invention, the outer pipe means has a rear end portion which is gradually decreased in diameter toward an extreme rear end.

According to the arrangement of the present invention, engine exhaust gas is passed during reverse movement from the exhaust passage means into the space between the outer pipe means and the hub means so as to pass therethrough. Thus, it is possible to prevent exhaust gas bubbles from passing along the propeller blades possibly causing the aforementioned problems.

The above and other objects and features of the present invention will become apparent from the following descriptions of preferred embodiments taking reference to the accompanying drawings, in which.

Figure 1:
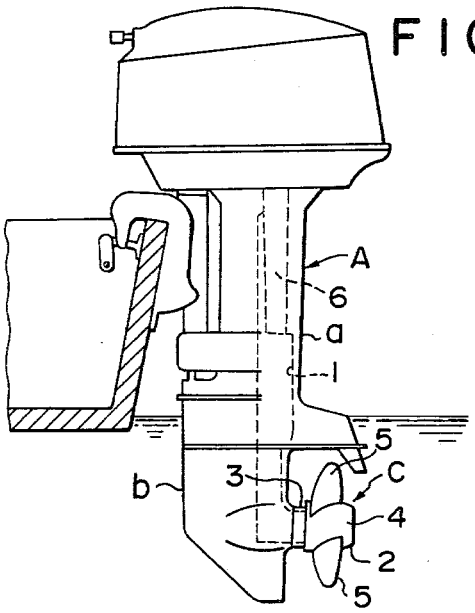
FIG. 1 is a side elevational view of an outboard marine propulsion unit embodying the feature of the present invention.
Figure 3:
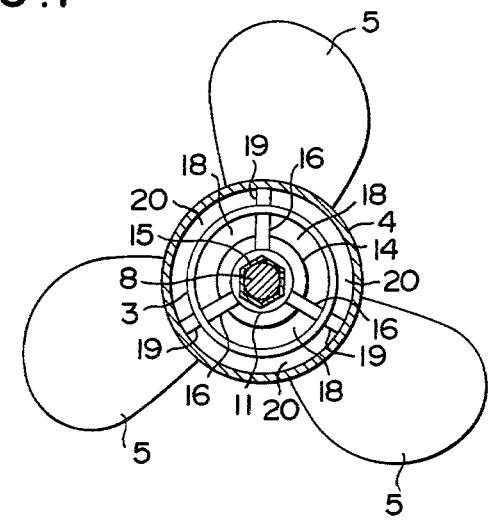
FIG. 3 is a sectional view taken substantially along the line III—III is FIG. 2.
Figure 2:
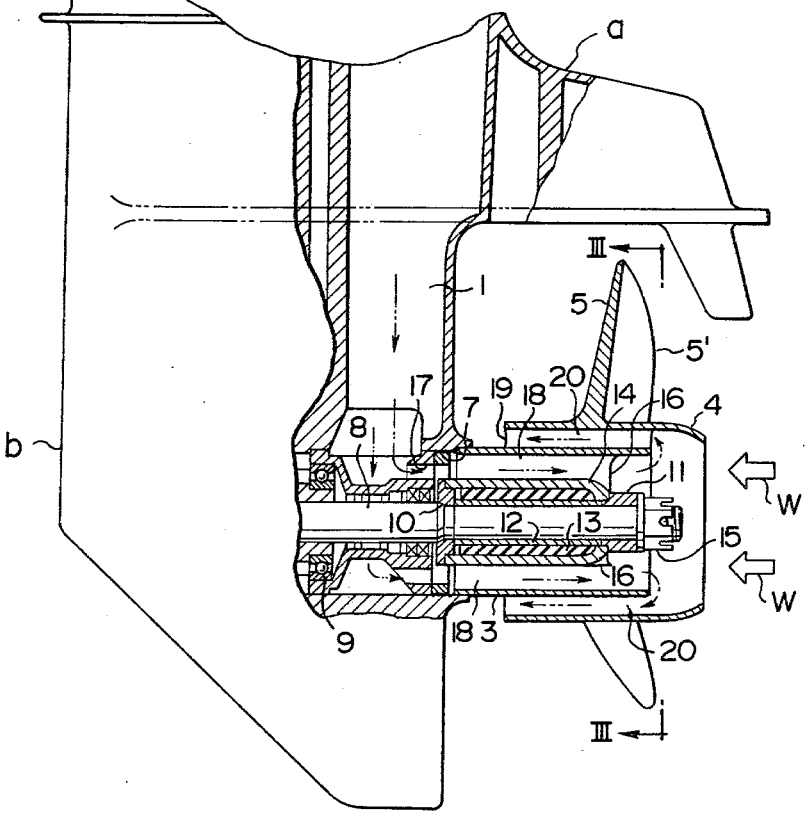
FIG. 2 is a sectional view specifically showing the propeller assembly in the propulsion unit.

Referring now to the drawings, particularly to FIGS. 1 through 3, the outboard marine propulsion unit shown therein by a reference character A includes an upper casing a, a lower casing b and a propeller assembly C mounted on the lower casing b. As well known in the art, an internal combustion engine is mounted on the upper casing a and has an exhaust pipe 6 extending downwardly in the upper casing a at the rear portion thereof. The housing constituted by the upper and lower casings a and b is formed with an exhaust gas passage 1 which leads to an opening 7 provided at the rear and lower portion of the casing b.

A propeller shaft 8 extends at the lower portion of the casing b rearwardly through the opening 7. Although not shown in the drawings, the propeller shaft 8 is driven by the engine through a vertically extending drive shaft. As shown in FIG. 2, the drive shaft 8 is supported rotatably by means of bearings 9 and has a rear end portion extending beyond the opening 7.

On the rear end portion of the propeller shaft 8, there is mounted the aforementioned propeller assembly C which comprises an outer hub 3 and an inner hub 14 which are integrally formed through radial walls 16 but radially spaced to define axially extending exhaust passages 18. The inner hub 14 is mounted on the rear end portion of the propeller shaft 8 through a cushioning member 13 and a sleeve 12. At the front and rear ends of the sleeve 12, there are mounted on the propeller shaft 8 a front and rear retaining rings 10 and 11, and nut 15 is threaded into the rear end of the propeller shaft 8 to secure the propeller assembly in position.

The housing of the bearing 9 is formed with suitable number of apertures 17 which connect the exhaust passage 1 in the unit housing with the exhaust passage 18 between the outer and inner propeller hubs 3 and 14. The propeller assembly includes an outer pipe 4 which encircles is integrally formed wiht the outer hub 3 through radial walls 19. Thus, passages 20 are formed between the outer hub 3 and the pipe 4. Propeller blades 5 are integrally formed with the outer pipe 4 in this embodiment.

As shown in FIG. 2, the outer pipe 4 has a formed end terminating at a portion forwardly of the propeller blades 5 and a rear end portion extending beyond the rear end of the outer hub 3. In the illustrated embodiment, the rear end portion of the outer pipe 4 has a diameter gradually decreasing toward the rear end but it may have a uniform diameter.

In the arrangement described above, when the propeller is driven in reverse direction for performing a reverse movement, the exhaust gas from the engine is discharged through the passages 1 and 18 into the rear end portion of the outer pipe 4. At this moment, however, since there is a flow of water as shown by arrows W in FIG. 2 due to the reverse movement, the exhaust gas is forced to flow through the passages 20. Thus, it is possible to prevent the exhaust gas bubbles passing along the propeller blades 5.

Figure 4:
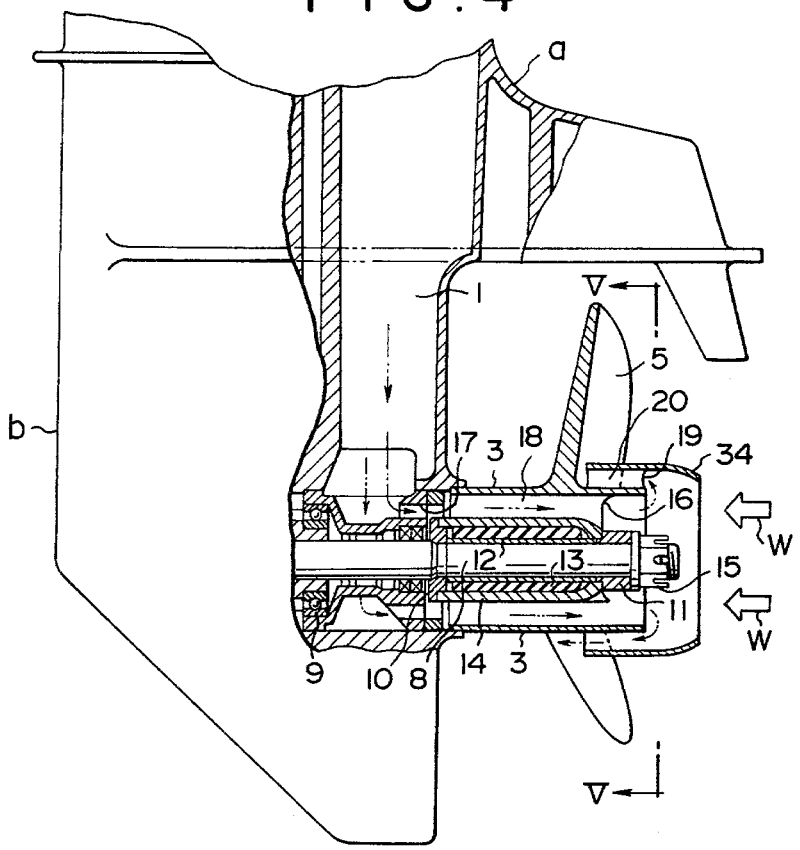
FIG. 4 is a sectional view similar to FIG. 2 but showing another embodiment of the present invention.
Figure 5:
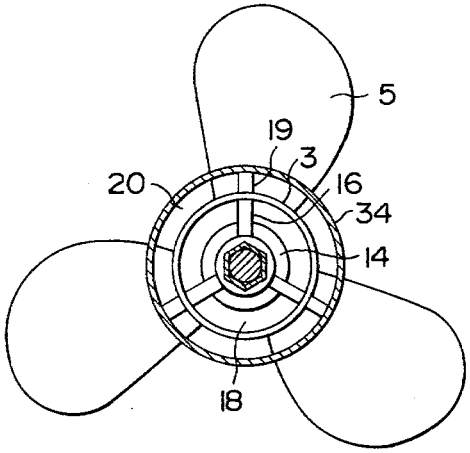
FIG. 5 is a sectional view taken substantially along the line V—V in FIG. 4.

Referring now to FIGS. 4 and 5, in the embodiment shown therein, the propeller blades 5 are formed integrally with the outer hub 3 and the outer pipe 34 which corresponds to the pipe 4 in the previous embodiment has a front end terminating forwardly of the trailing edges but rearwardly of the leading edges of the blades 5. In this arrangement, the exhaust gas bubbles may pass along the root portions of the propeller blades 5, however, since the root portions of the blades 5 are in the stall region of the propeller, there will be no adverse effect. The front end of the outer pipe 34 may terminate even at the rearward side of the blade trailing edge.

Figure 6:
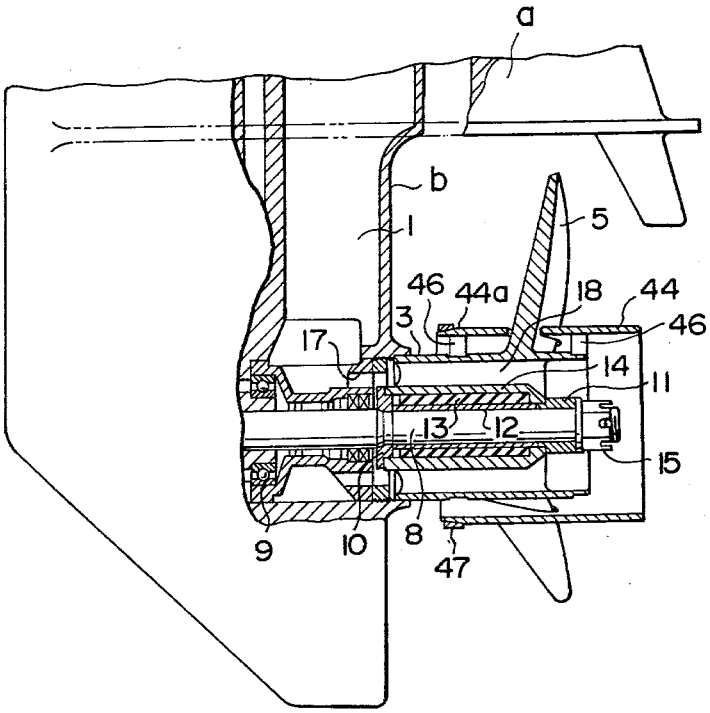
FIG. 6 is a sectional view similar to FIGS. 2 and 4 but showing a further embodiment.
Figure 7:
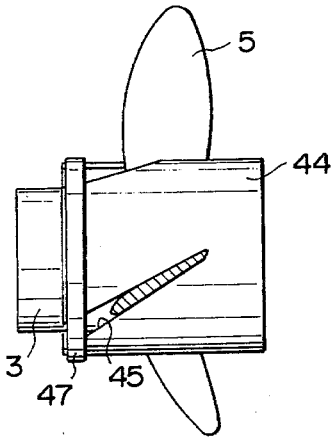
FIG. 7 is an elevational view of the embodiment shown in FIG. 6.

In the embodiment shown in FIGS. 6 and 7, the outer pipe 44 is formed separately from the other parts of the propeller. More specifically, the outer pipe 44 is formed with slits 45 extending spirally from the front end thereof for inserting the propeller blades 5. At the inside of the pipe 44, there are provided posts or struts 46 which serve to support the outer pipe 44 on the outer hub 3. The outer pipe 44 has a front end **44*a* of which outer surface is forwardly tapered and a retaining ring 47 is fitted to the front end 44*a*. The retaining ring 47 may be adhesively attached to the outer pipe 44** or clamped in an appropriate manner.

Figure 8:
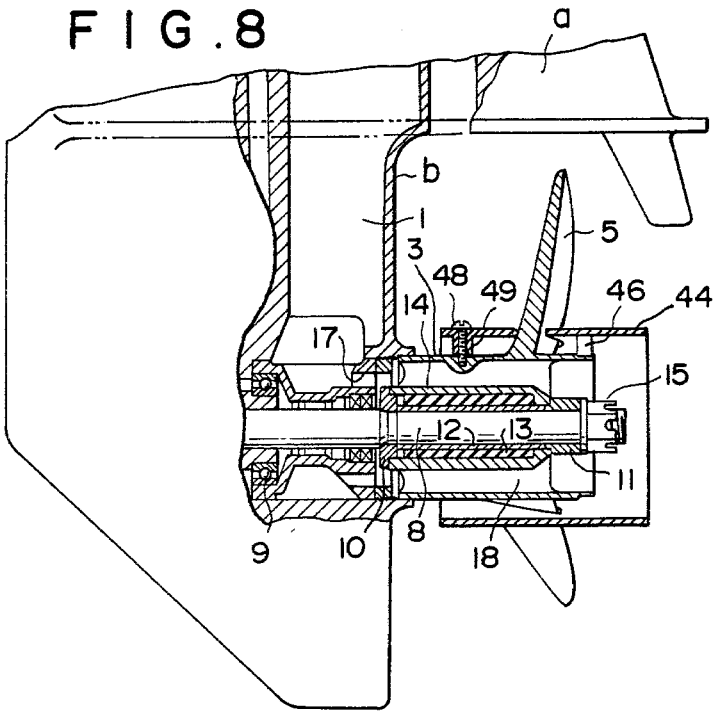
FIG. 8 is a sectional view showing a further embodiment of the present invention.

The embodiment shown in FIG. 8 is similar to the embodiment shown in FIGS. 6 and 7. In this embodiment, however, the outer pipe 44 is secured to the outer hub 3 through bolts 48 threaded through spacers 49 into the hub 3.

Figure 9:
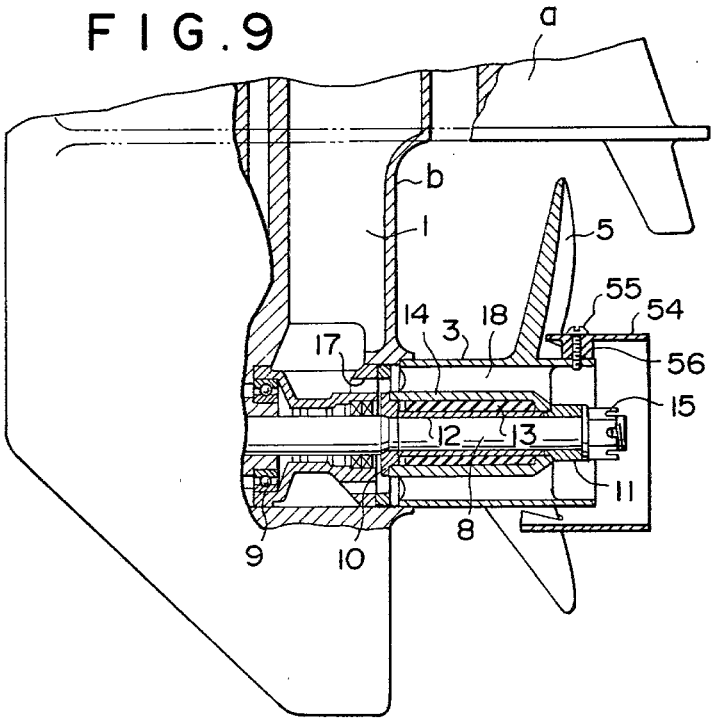
FIG. 9 is a sectional view showing still further embodiment of the present invention.

In the embodiment shown in FIG. 9, the outer pipe 54 has a front end terminating at a portion intermediary of the leading and trailing edges of the propeller blades 5. The pipe 54 is secured to the outer hub 3 by means of screws 55 which are threaded through spacers 56 into the hub 3.

The invention has thus been shown and described with reference to specific embodiments however, it should be noted that the invention is in no way limited to the details of the illustrated structures but changes and modifications may be made within the scope of the appended claims.

We claim:

1. Marine propulsion unit comprising housing means which is formed with engine exhaust gas passage means and has a lower portion supporting propeller shaft means, propeller means mounted on said propeller shaft means and including hub means and blade means, said hub means being formed with exhaust passage means which is extending axially along the hub means and connected at one end with said exhaust gas passage means in the housing means, the other end of the exhaust passage means being opened rearwardly of the hub means, outer pipe means having a portion radially spaced apart from said hub means and extending substantially parallel with said hub portion to surround at least the rear portion of said hub means, said outer pipe means extending rearwardly beyond said other end of the exhaust passage means in the hub means, said outer pipe means having a front end which is located forwardly of trailing edge of said blade means.

2. Marine propulsion unit in accordance with claim 1 in which said outer pipe means is formed integrally with said hub means.

3. Marine propulsion unit in accordance with claim 1 in which said outer pipe means is formed separately from and secured to said hub means.

4. Marine propulsion unit in accordance with claim 1 in which said outer pipe means is located fowardly of said blade means.

5. Marine propulsion unit in accordance with claim 1 in which said outer pipe means has a front end located at a portion between leading and trailing edges of the blade means.

* * * * *

UNITED STATES PATENT AND TRADEMARK OFFICE

CERTIFICATE OF CORRECTION

PATENT NO. : 4,276,036

DATED : June 30, 1981

INVENTOR(S) : Nishida et al.

It is certified that error appears in the above—identified patent and that said Letters Patent is hereby corrected as shown below:

On the title page, Item [73] "Matsudoki" should read:
--- Hatsudoki ---.

Signed and Sealed this

*Seventeenth* Day of *November 1981*

[SEAL]

*Attest:*

GERALD J. MOSSINGHOFF

*Attesting Officer*

*Commissioner of Patents and Trademarks*